US007296455B2

(12) United States Patent
Durney

(10) Patent No.: US 7,296,455 B2
(45) Date of Patent: Nov. 20, 2007

(54) TOOL SYSTEM FOR BENDING SHEET MATERIALS AND METHOD OF USING SAME

(75) Inventor: Max W. Durney, San Francisco, CA (US)

(73) Assignee: Industrial Origami, Inc., San Francisco, CA (US)

( * ) Notice: Subject to any disclaimer, the term of this patent is extended or adjusted under 35 U.S.C. 154(b) by 0 days.

(21) Appl. No.: 10/938,170

(22) Filed: Sep. 10, 2004

(65) Prior Publication Data

US 2006/0053857 A1 Mar. 16, 2006

(51) Int. Cl.
*B21D 5/02* (2006.01)

(52) U.S. Cl. ..... 72/306; 72/319; 72/379.2

(58) Field of Classification Search ..... 72/214–219, 72/319, 320, 321, 323, 316, 387, 388, 306, 72/379.2; 140/107
See application file for complete search history.

(56) References Cited

U.S. PATENT DOCUMENTS

| | | | | |
|---|---|---|---|---|
| 3,120,257 | A * | 2/1964 | Heinz et al. | 72/458 |
| 3,774,434 | A * | 11/1973 | Bock | 72/306 |
| 4,133,198 | A | 1/1979 | Huda et al. | |
| 4,230,058 | A | 10/1980 | Iwaki et al. | |
| 4,383,430 | A * | 5/1983 | Klaus | 72/387 |
| 4,468,946 | A | 9/1984 | Driear | |
| 4,515,004 | A * | 5/1985 | Jaenson | 72/388 |
| 5,105,640 | A | 4/1992 | Moore | |
| 6,065,323 | A | 5/2000 | Arduino et al. | |
| 6,233,538 | B1 | 5/2001 | Gupta et al. | |
| 6,481,259 | B1 | 11/2002 | Durney | |
| 6,640,605 | B2 | 11/2003 | Gitlin et al. | |
| 6,745,608 | B2 | 6/2004 | Miura | |
| 6,877,349 | B2 | 4/2005 | Durney et al. | |
| 2002/0184936 | A1 | 12/2002 | Gitlin et al. | |
| 2003/0037586 | A1 | 2/2003 | Durney et al. | |
| 2004/0134250 | A1 | 7/2004 | Durney et al. | |
| 2004/0206152 | A1 | 10/2004 | Durney et al. | |
| 2005/0005670 | A1 | 1/2005 | Durney et al. | |
| 2005/0061049 | A1 | 3/2005 | Durney et al. | |
| 2005/0064138 | A1 | 3/2005 | Durney et al. | |
| 2005/0097937 | A1 | 5/2005 | Durney et al. | |
| 2005/0126110 | A1 | 6/2005 | Durney et al. | |

* cited by examiner

*Primary Examiner*—Daniel C Crane
(74) *Attorney, Agent, or Firm*—Morgan, Lewis & Bockius LLP; David J. Brezner; Victor E. Johnson

(57) ABSTRACT

A bending tool system is provided for forming a three-dimensional structure from a two-dimensional sheet material which includes a predetermined fold line. The system includes a tool base for receiving and supporting the sheet material in a work plane, a clamp for engaging against the sheet material to secure a portion of the sheet material relative to the tool base, a locator for positioning the sheet material relative to the tool base such that the clamp extends through the clamping aperture, and a bending arm located adjacent the clamp, the bending arm movable from an initial position located below the work plane to an upper position in order to apply an upward force against an unsecured portion of the sheet metal to effect bending of the sheet material about the fold line. A method of using the tool system for bending sheet materials is also described.

26 Claims, 14 Drawing Sheets

TOOL SYSTEM FOR BENDING SHEET MATERIALS AND METHOD OF USING SAME

BACKGROUND OF THE INVENTION

1. Field of the Invention

This invention relates, in general, to tool systems for bending sheet materials and methods for their use.

2. Description of Related Art

Bending two-dimensional (2D) sheet materials to form three-dimensional (3D) structures is known. Machinery and tooling for effecting bends in 2D sheet materials is also known. Generally, such machinery and tooling receives the sheet material in a horizontal orientation. For example, U.S. Pat. No. 4,133,198 to Huda et al. discloses an apparatus for bending large area construction units. U.S. Pat. No. 4,230,058 to Iwaki et al. shows an apparatus that is configured to manufacture box-shaped structures from metal sheet. U.S. Pat. No. 5,105,640 to Moore discloses an apparatus for forming box-shaped sheet metal ducts from sheet material.

Disadvantageously, such known apparatuses generally have presses and/or clamping members disposed above the horizontally-oriented sheet material which serve to clamp or shape the sheet material. While such componentry may be effective in their intended purposes, such presses and/or clamping members may present severe physical harm to an operator whom inadvertently catches a finger or limb within such componentry or between such componentry and the sheet material during the clamping or bending process.

Furthermore, such known apparatuses generally clamp the sheet materials such that a significant portion of the sheet materials overhang the apparatus, allowing the overhanging portion to swing unobstructed during the bending process. Again, severe physical harm may come to an inattentive operator in that the swinging portion of the sheet material may strike and injure the operator during the bending process.

Another disadvantage of such known apparatuses is that they are generally configured for forming a particular 3D structure and may require significant time and expense in retooling in order to be used with another 3D structure.

What is needed is a tool system for bending sheet materials which overcomes the above and other disadvantages of known bending machinery and tooling.

BRIEF SUMMARY OF THE INVENTION

One aspect of the present invention is directed to a bending tool system for forming a three-dimensional structure from a two-dimensional sheet material which includes a predetermined fold line and a clamping aperture adjacent the fold line and spaced from a peripheral edge of the sheet material. The system includes a tool base for receiving and supporting the sheet material in a work plane, an actuator slot in the tool base, and a bend actuator extending through the actuator slot. The bend actuator includes a mounting bracket, a clamp connected to the bracket, and a bending arm connected to the bracket. The clamp extends above the tool base and is movable between an open position and a secured position for securing a portion of the sheet material relative to the tool base. The bending is movable between an initial position located below the work plane and an upper position in order to apply a force against an unsecured portion of sheet material to effect bending of the sheet material about the fold line. The system may further include a locator for positioning the sheet material relative to the work base such that the clamp extends through the clamping aperture of the sheet material.

The tool base may be configured to be used with a particular sheet material design having a peripheral shape and predefined fold pattern, wherein the tool base further includes an outline corresponding to the peripheral shape for identifying the particular sheet material design to be worked on the tool base. The system may further include one or more legs removably attached to the tool base for supporting the tool base and providing access to the aperture slots from below the tool base. The system may further include a rest removably attached to the tool base for supporting the sheet material above the tool base in the work plane. The tool base may have a first bore having a first size and shape complimentary to the locator, a second bore having a second size and shape complimentary to the legs, and a third bore having a third size and shape complementary to the rest, whereby the respective size and shape of the bores provide visual indication of the location of the locater, legs and rest.

The bracket may include having a channel and an opposing jaw with a downward-facing shoulder, wherein an upper portion of the bend actuator is inserted through the actuator slot from below the tool base, the channel is interlocked to one end of the actuator slot, and the bend actuator is dropped downward to abut the downward-facing shoulder against an opposite end of the actuator slot to secure the actuator to the tool base.

The bend actuator may include a driver operably connected to the bending arm, wherein actuation of the driver moves the bending arm between the initial position and the upper position. The driver may be operably connected to the clamp such that actuation of the driver also moves the clamp between the open position and the engaged position. The driver may be a pneumatic cylinder having a cylinder stroke, wherein a first portion of the cylinder stroke effects movement of the clamp and a second portion of the cylinder stroke effects movement of the bending arm. The clamp may be pivotally mounted on the bracket and the bending arm may be pivotally mounted on the clamp. One end of the pneumatic cylinder may be operably connected to the bracket and an opposite end of the pneumatic cylinder may be operably connected to the bending arm.

The sheet material may have a predetermined pattern of fold lines and a clamping aperture adjacent each of the fold lines, in which case, the system may include a plurality of bend actuators positioned to effect bending along a respective fold line. The tool base may include a corresponding actuator slot for each bend actuator.

Each bend actuator may include a driver for moving each respective bending arm between the initial position and the upper position and for moving a respective clamp between the open position and the engaged position.

The system may include a programmable logic controller for controlling the actuation sequence of the drivers and the actuation force and dwell time of each driver. The driver may be a pneumatic cylinder having a cylinder stroke, and the controller may provide two-stage actuation of each driver wherein the driver controls a first portion of the cylinder stroke to effect movement of the clamp and a second portion of the cylinder stroke to effect movement of the bending arm.

Another aspect of the present invention is directed to a bending tool system including a tool base for receiving and supporting the sheet material in a work plane, a clamp for engaging against the sheet material to secure a portion of the sheet material relative to the tool base, a locator for positioning the sheet material relative to the tool base such that the clamp extends through the clamping aperture, and a bending arm located adjacent the clamp, the bending arm movable from an initial position located below the work plane to an upper position in order to apply an upward force against an unsecured portion of the sheet metal to effect bending of the sheet material about the fold line.

The bend actuator may include the bending arm and the tool base may include an actuator slot configured to removably receive a portion of the bend actuator inserted through the actuator slot. The bend actuator may include a bracket having a channel and an opposing jaw with a downward-facing shoulder, wherein an upper portion of the bend actuator may be inserted through the actuator slot from below, the channel may be interlocked to one end of the actuator slot, and the bend actuator may be dropped downward to abut the downward-facing shoulder against an opposite end of the actuator slot to secure the actuator to the tool base.

The bend actuator may include a driver operably connected to the bending arm, wherein actuation of the driver moves the bending arm between an initial position located below the work plane and an upper position located above the work plane. The bend actuator may include the clamp, wherein the driver may be operably connected to the clamp such that actuation of the driver also moves the clamp between an open position free of the sheet material and an engaged position holding the sheet material down relative to the tool base.

Yet another aspect of the present invention is directed to a method of forming a three-dimensional structure from a two-dimensional sheet material which includes a predetermined fold line. The method includes one or more of the steps: forming a clamping aperture in the sheet material adjacent the fold line and spaced from a peripheral edge of the sheet material; positioning the sheet material on a tool base such that the clamp extends through the clamping aperture, a lower surface of the sheet material defining a work plane above the tool base; engaging the clamp against the sheet material to secure a portion of the sheet material relative to the tool base; and moving a bending arm, located adjacent to the clamp, from an initial position below the work plane to an upper position thereby applying an upward force against an unsecured portion of the sheet metal to effect bending of the sheet material about the fold line.

The bend actuator may include the bending arm and the tool base may include an actuator slot configured to removably receive the bend actuator, in which case, the method may include inserting a portion of the bend actuator through the actuator slot and securing the actuator to the work base. The bend actuator may include a bracket having a channel and an opposing jaw with a downward-facing shoulder, in which case, the inserting and securing step may include inserting an upper portion of the bend actuator through the actuator slot from below, interlocking the channel against one end of the actuator slot, and dropping the actuator downward such that the downward-facing shoulder abuts against an opposite end of the actuator slot thereby securing the actuator to the tool base.

The bend actuator may include a driver operably connected to the bending arm, wherein the moving step may be accomplished by actuating the driver to move the bending arm from the initial position located below the work plane to the upper position located above the work plane. The bend actuator may include the clamp and the driver may also be operably connected to the bending arm, in which case, the engaging step may be accomplished by actuating the driver to move the clamp from an open position free of the sheet material to an engaged position holding the sheet material down relative to the tool base.

A further aspect of the present invention is directed to a tool system for forming a three-dimensional structure from a two-dimensional sheet material which is to be folded along a line, the sheet material including an opening adjacent the line to allow holding the sheet material. The system includes support means for receiving and supporting the sheet material, the means having at least one slot formed therein, actuator means extending through the slot, the actuator means including a mounting means, holding means connected to the mounting means, extending from the support means, and movable between one position and another position for securing a portion of the sheet material relative to the support means, bending means connected to the mounting means and movable between an initial position and another position in order to apply a force against an unsecured portion of the sheet material to effect bending of the sheet material about the line, and means for positioning the sheet material relative to the support means such that the holding means extends through the opening of the sheet material.

A further still aspect of the present invention is directed to a method of forming a three-dimensional structure from a two-dimensional sheet material which is to be folded along at least one line. The method may include one or more of the following steps: forming an opening in the sheet material adjacent the at least one line; positioning the sheet material on a support such that the sheet material can be held in place through the opening; holding the sheet material through the opening to secure a portion of the sheet material relative to the support; and moving a bending member, located adjacent to the area where the sheet material is being held, from one position to another position, thereby applying a force against an unsecured portion of the sheet metal to effect bending of the sheet material about the at least one line.

The tool system for bending sheet materials of the present invention has other features and advantages which will be apparent from or are set forth in more detail in the accompanying drawings, which are incorporated in and form a part of this specification, and the following Detailed Description of the Invention, which together serve to explain the principles of the present invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
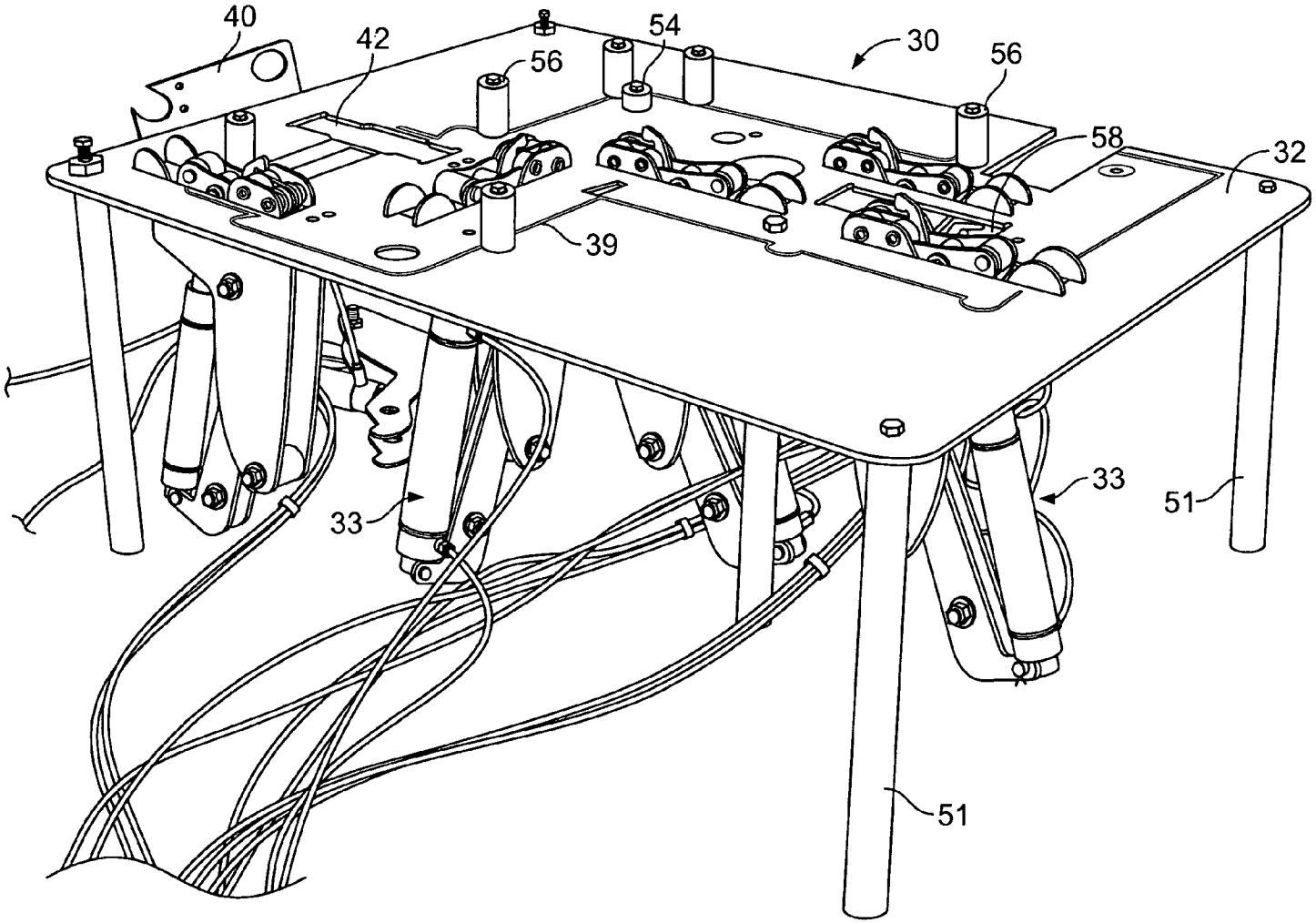
FIG. 1 is a perspective view of tool system for bending sheet materials in accordance with the present invention having a work plane supporting a plurality of modular actuator assemblies and other components.

Turning now to the drawings, wherein like components are designated by like reference numerals throughout the various figures, attention is directed to FIG. 1 which illustrates a bending tool system generally designated by the numeral 30 that may be used to fold two-dimensional (2D) sheet materials into three-dimensional (3D) shapes.

The bending tool system of the present invention is particularly suited for bending 2D sheet materials having engineered fold lines utilizing various fold geometries and configurations including, but not limited to, those disclosed by U.S. Pat. No. 6,481,259 to Durney, U.S. patent application Ser. No. 10/256,870, filed Sep. 26, 2002 and entitled METHOD FOR PRECISION BENDING OF SHEET OF MATERIALS, SLIT SHEETS AND FABRICATION PROCESS, U.S. patent application Ser. No. 10/672,766, filed Sep. 26, 2003 and entitled TECHNIQUES FOR DESIGNING AND MANUFACTURING PRECISION-FOLDED, HIGH STRENGTH, FATIGUE-RESISTANT STRUCTURES AND SHEET THEREFOR, U.S. patent application Ser. No. 10/795,077, filed Mar. 3, 2004 and entitled SHEET MATERIAL WITH BEND CONTROLLING DISPLACEMENTS AND METHOD FOR FORMING THE SAME, U.S. patent application Ser. No. 10/821,818, filed Apr. 4, 2004 and entitled METHOD OF DESIGNING FOLD LINES IN SHEET MATERIAL, and U.S. patent application Ser. No. 10/861,726, filed Jun. 4, 2004 and entitled TECHNIQUES FOR DESIGNING AND MANUFACTURING PRECISION-FOLDED, HIGH STRENGTH, FATIGUE-RESISTANT STRUCTURES AND SHEET THEREFOR, the entire contents of which patent and patent applications are incorporated herein by this reference. Unlike known apparatuses, the bending tool system of the present invention allows the use of 2D sheet materials to build 3D structures around components in a manner that is described in the above mentioned patents.

One will appreciate, however, that the bending tool system of the present invention is also suited for bending other types of sheet materials about a fold line including, but not limited to, the above-mentioned engineered fold lines, predetermined fold lines defined by scoring and/or other suitable means, or intended bend lines in which the sheet materials do not have any physical structure extending along the bend line for promoting bending along the bend line.

Generally, bending tool system 30 includes a tool base 32 and one or more bend actuators 33 which are arranged such that each is positioned under a corresponding fold line 35 of a work piece 37 (not shown in FIG. 1). The bend actuators are configured to secure a portion of the work piece to the tool base and apply force against an unsecured portion of the work piece to effect bending along the fold line, as is discussed in greater detail below.

As can be seen in FIG. 1, bending tool system 30 of the present invention includes little folding equipment on top of the tool base and, in particular, does not include equipment that exerts force or pressure on the work piece from above. Thus, the bending tool system promotes safety as it minimizes the likelihood of an operator getting pinched. All of the effort is being done from below thereby providing an easier, faster and safer mode of assembly.

Tool base 32 may be formed of a metal plate or other suitable structure which provides a stable base for supporting actuators 33. The tool base may be dedicated to a particular work piece such that the tool base positions one or more actuators along each fold line of the work piece. In the event that the tool base is configured for use with a particular work piece design, the tool base may include an outline 39 of the particular work piece design thereby providing an operator with visual means identifying the type of work piece for which the tool base is configured. In the illustrated embodiment, tool base 32 is configured for bending work piece 37 into a chassis for support of components such as electrical components, in a manner that is described in, and illustrated by FIGS. 28A-28E of U.S. Patent Application Publication No. U.S. 2004/0134250 A1 to Durney ("the '250 application"), the entire content of which application is incorporated herein by this reference.

Figure 6:
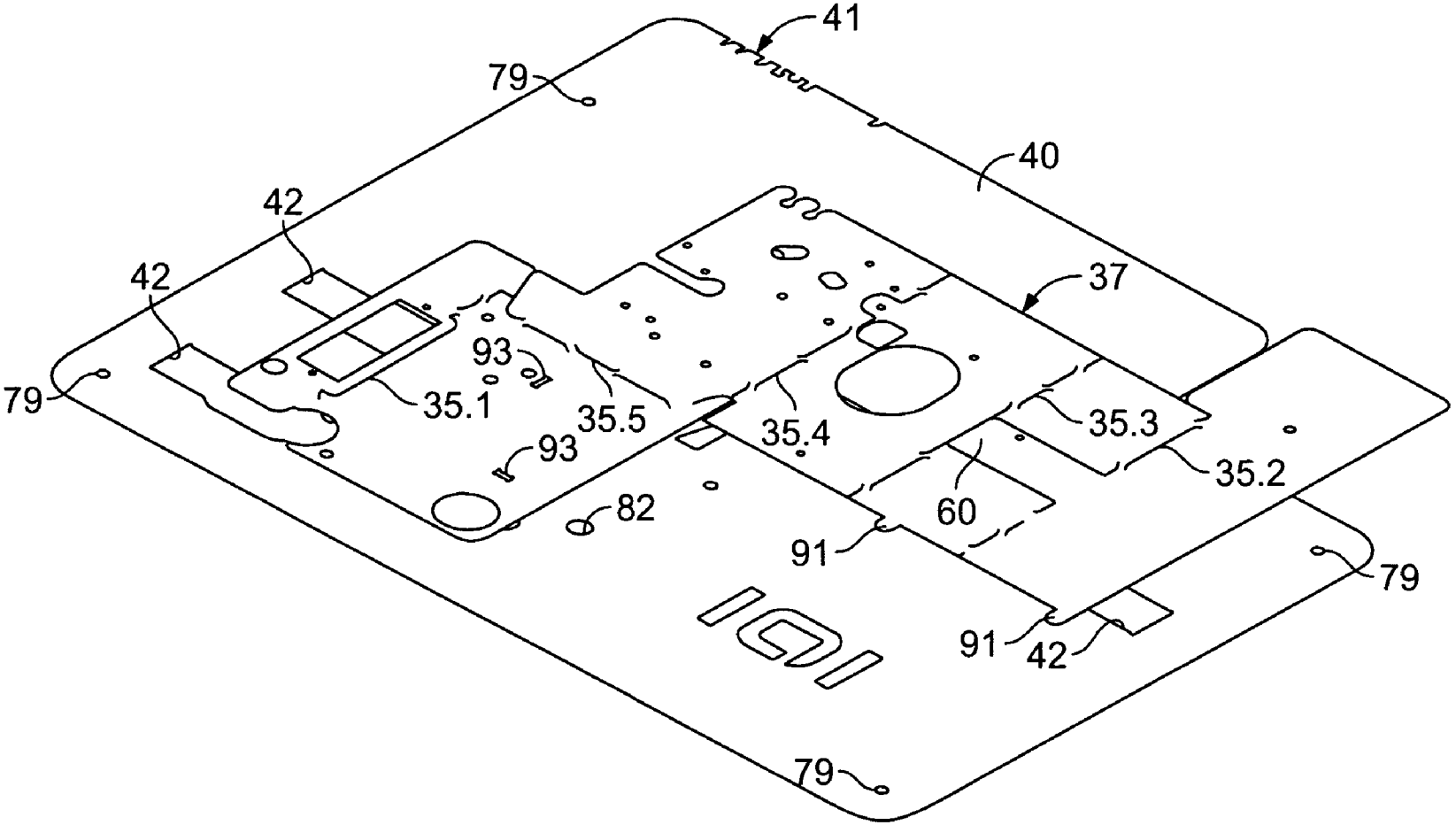
FIG. 6 is a perspective view of an exemplary sheet-material work piece, which may be folded in to a three-dimensional structure using the tool system of FIG. 1, superimposed on the tool base of FIG. 1, the sheet-material work piece shown in an initial two-dimensional, substantially planar initial state.
Figure 7A:
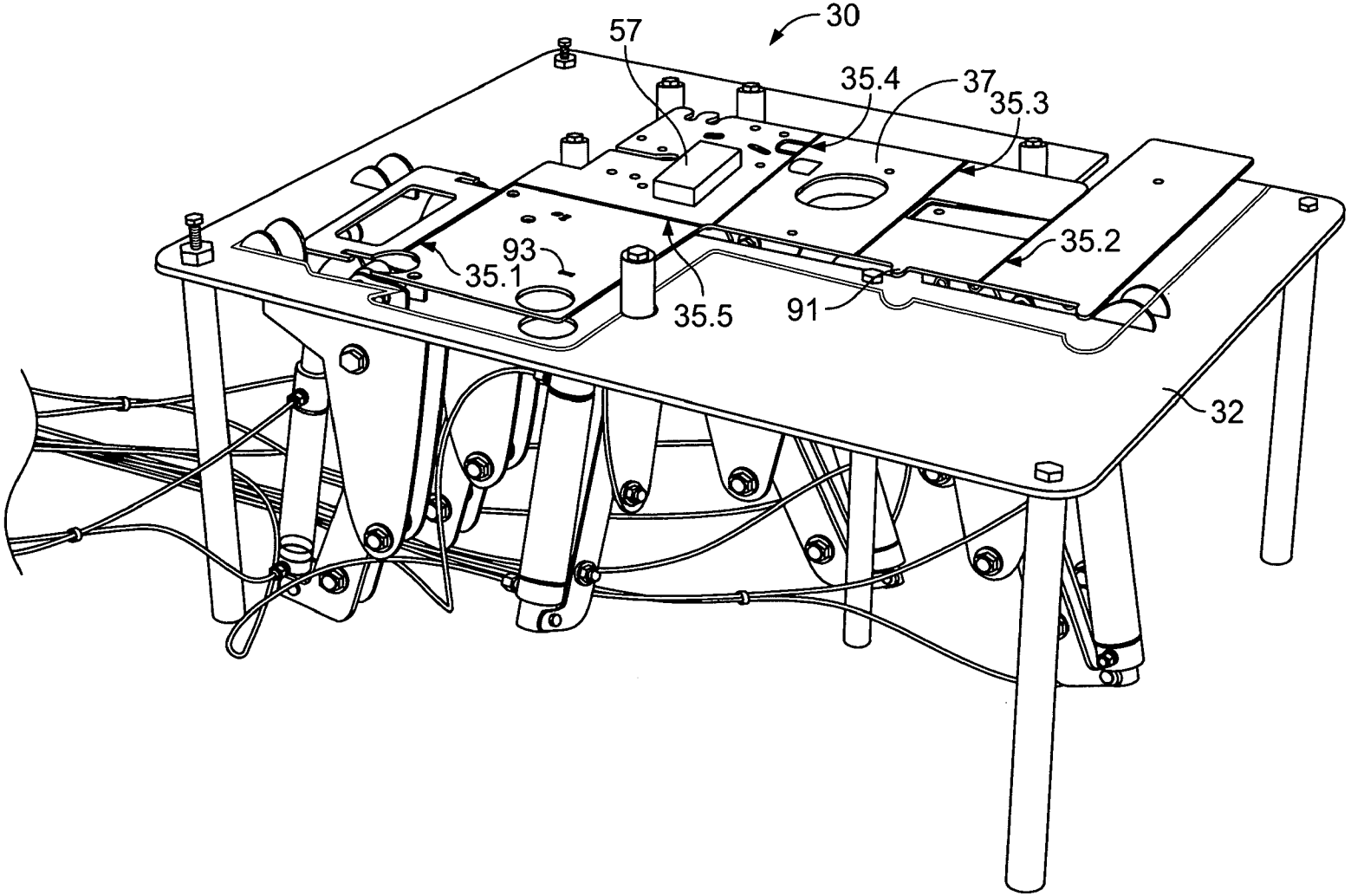
FIG. 7(*a*), 7(*b*), 7(*c*), 7(*d*), 7(*e*) and 7(*f*) are a schematic, perspective views of the work piece of FIG. 6 positioned on the modular actuator assembly of FIG. 1, and subsequent fold steps utilized to from the work piece into a three-dimensional structure.
Figure 7B:
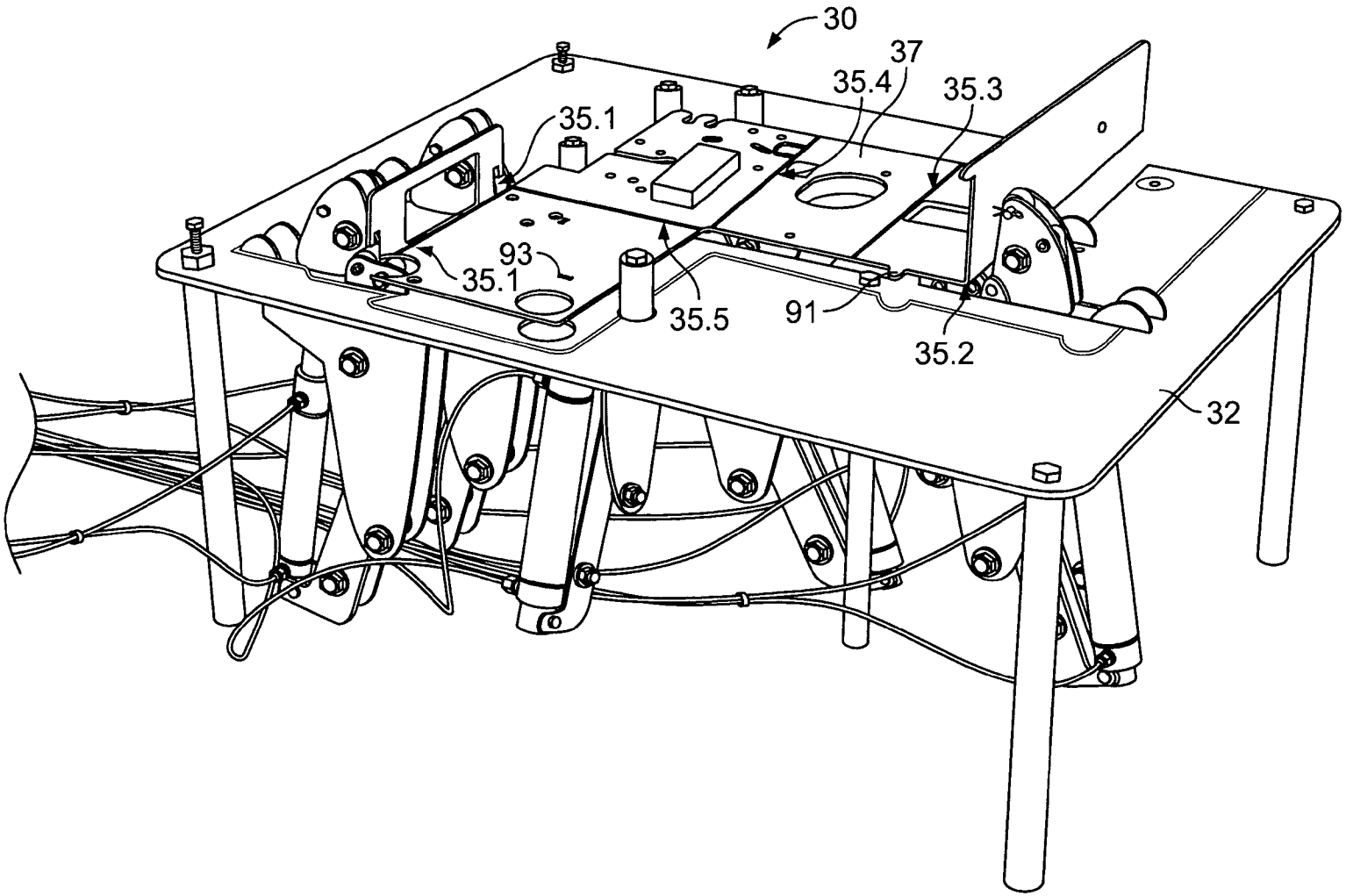
Figure 7C:
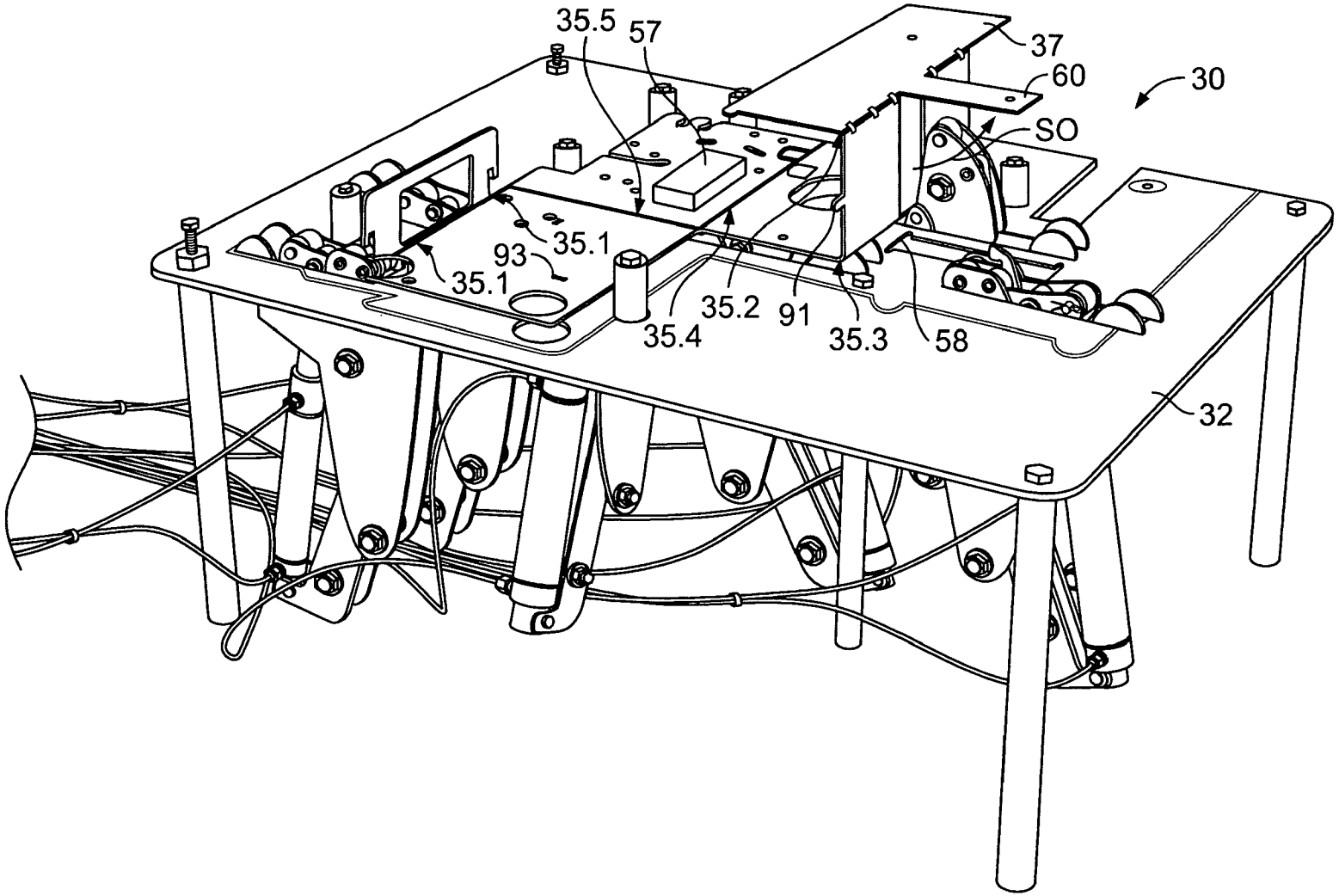
Figure 7D:
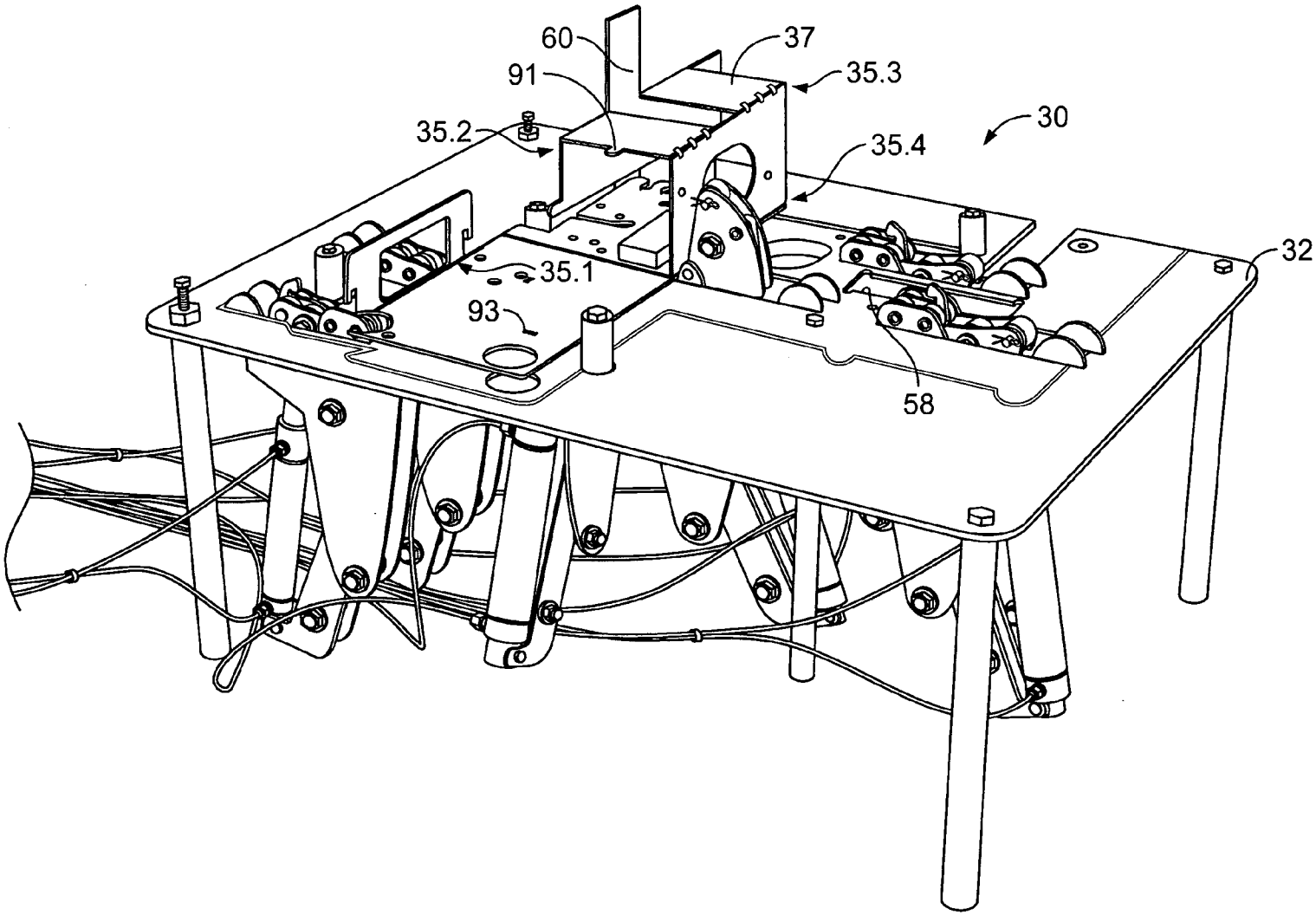
Figure 7E:
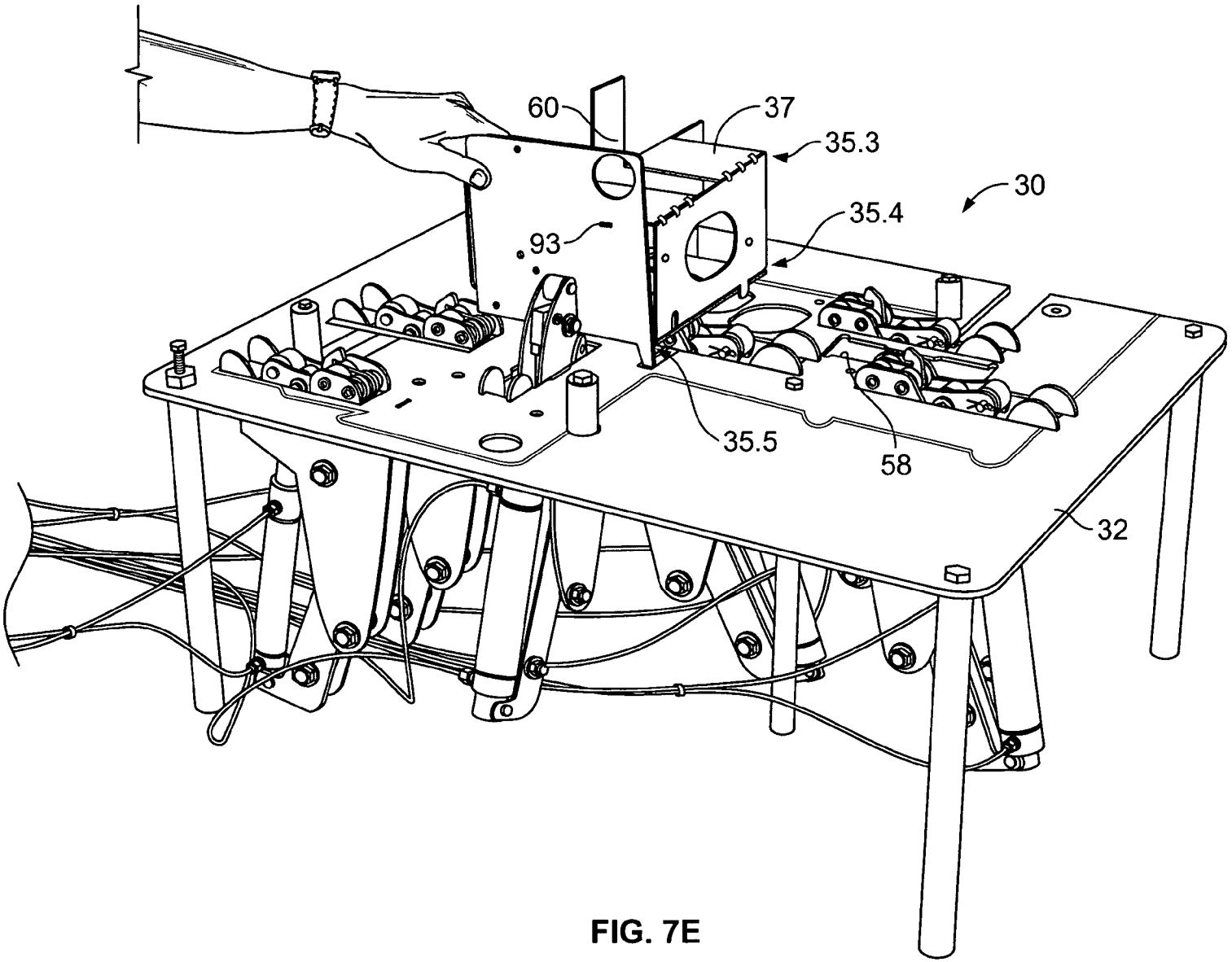
Figure 7F:
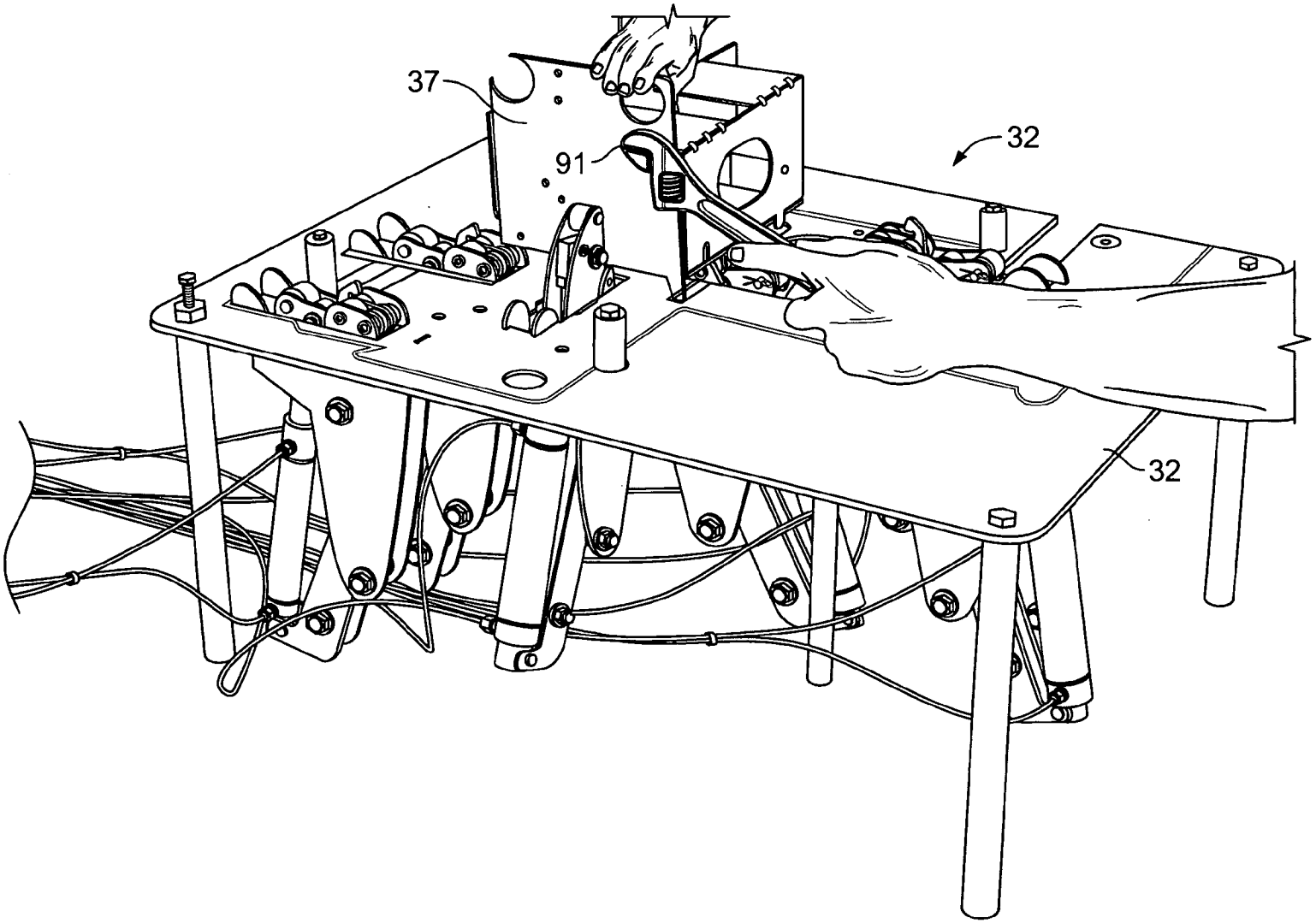

Outline 39 may be applied to tool base 32 by etching, painting, printing and/or other suitable means. In addition to, or in place of, the outline, the tool base may also be provided with an identification flange 40 upon which an edge code 41 (FIG. 6) may be etched into or otherwise marked on the flange to identify the particular silhouette of the work piece that corresponds to the particular tool base. In the illustrated embodiment, the edge code is a geometric pattern, however, one will appreciate that the edge code may be in the form of numerals, letters, shapes and other suitable means to provide a unique identifying indicia corresponding to a particular work piece.

Figure 2:
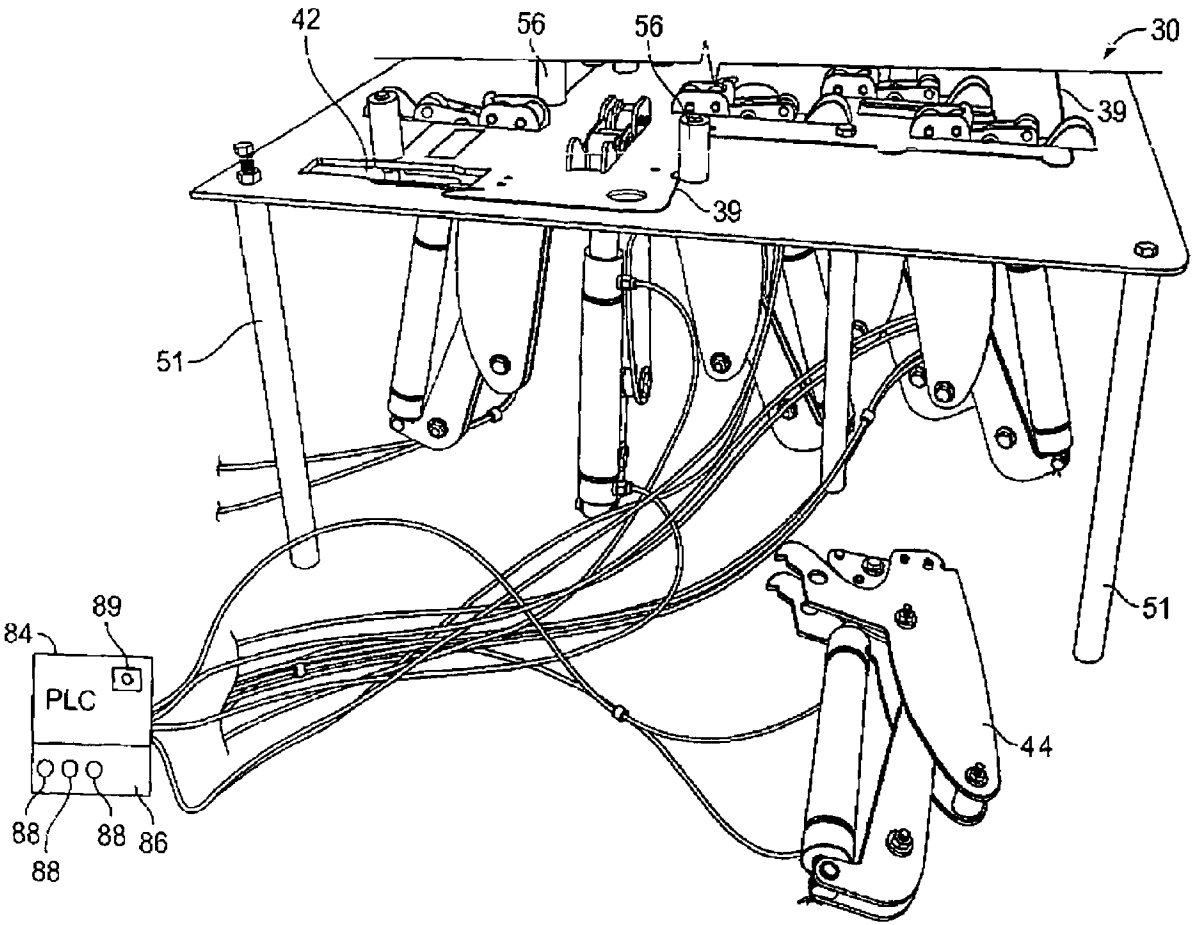
FIG. 2 is a perspective view of the tool system of FIG. 1 with a modular actuator assembly removed from the work plane.
Figure 3:
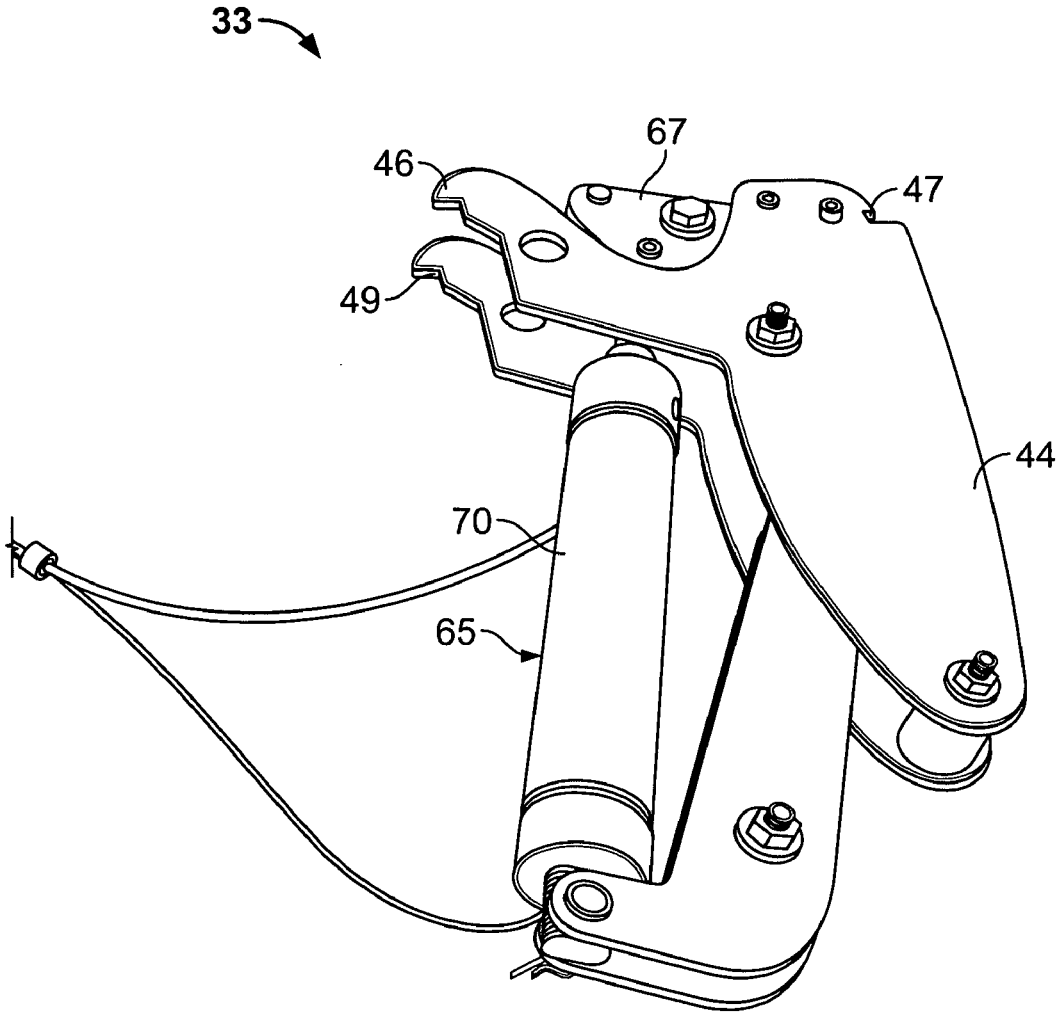
FIG. 3 is an enlarged perspective view of the modular actuator assembly of FIG. 2.
Figure 4A:
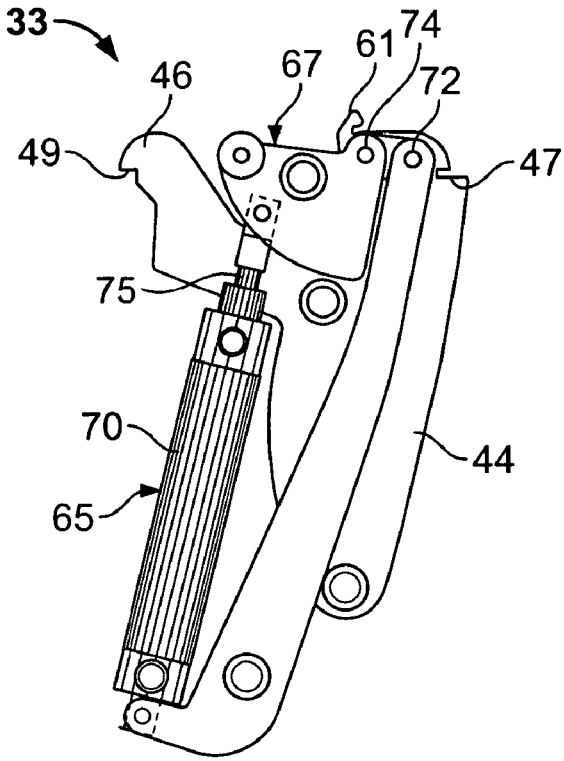
FIG. 4(*a*), 4(*b*) and 4(*c*) are a schematic, side elevational views of the modular actuator assembly of FIG. 2 illustrating the modular actuator in initial, clamp, and bend positions, respectively.
Figure 4B:
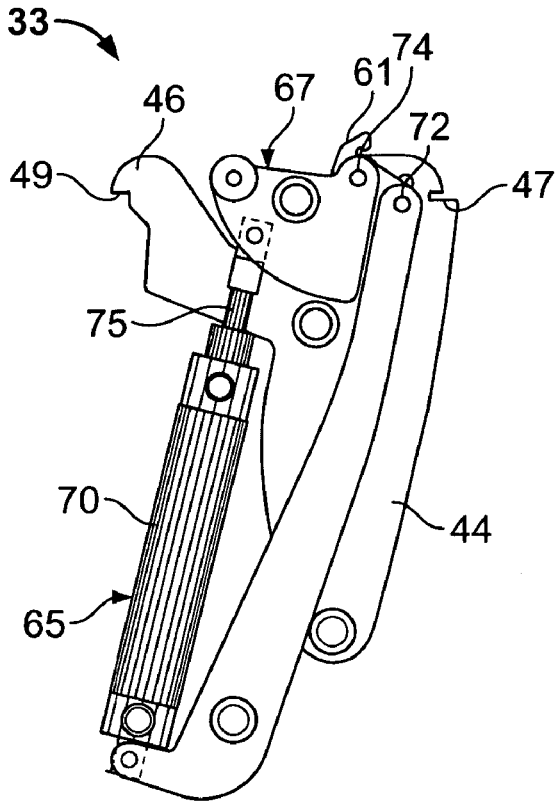
Figure 4C:
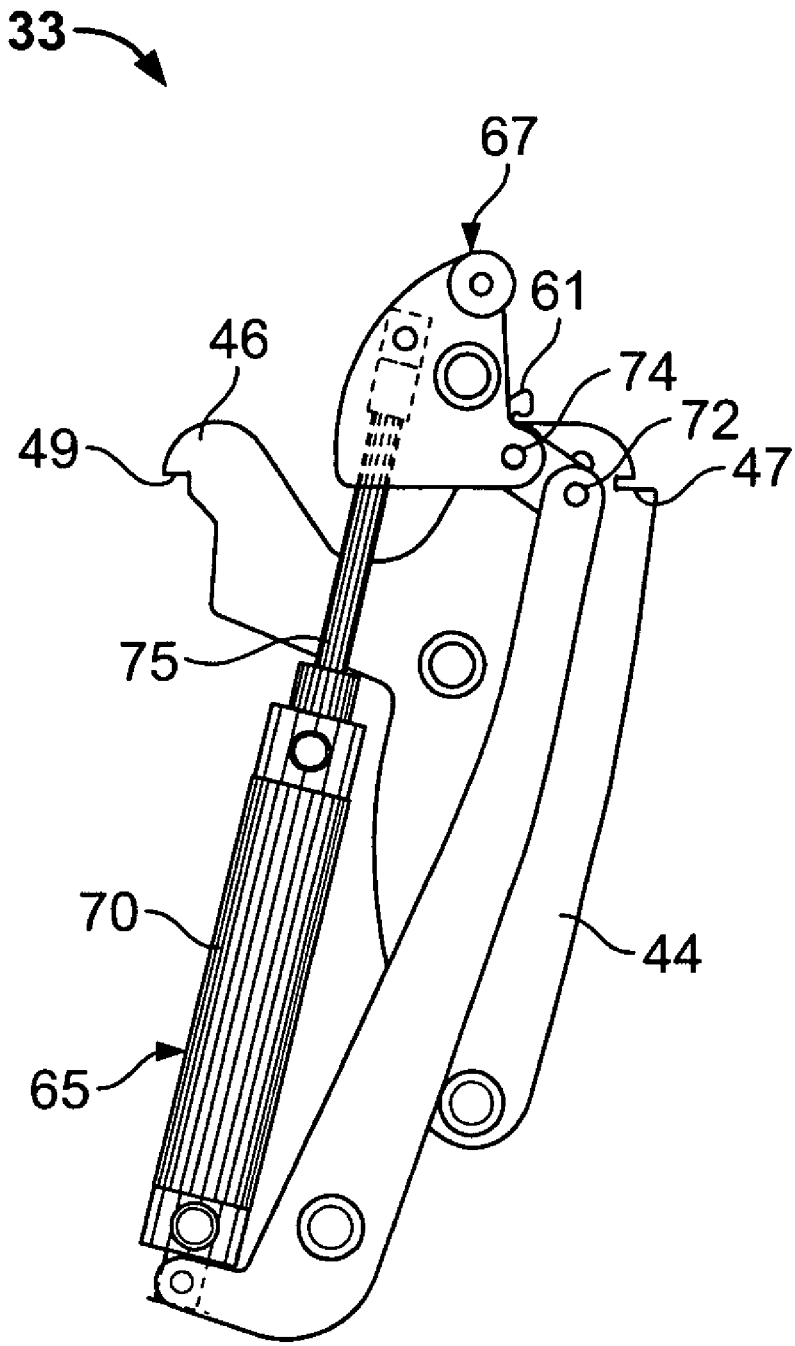

As shown in FIG. 2, bend actuators 33 are removably supported by the tool base and have a modular design such that the actuators may be readily removed from one tool base and installed on another as necessary or so desired. Tool base 32 includes an actuator slot 42 for each bend actuator. In the illustrated embodiment, the bend actuators have a "drop-in" design such that it may be partially inserted through the actuator slot from below and dropped into place. With reference to FIG. 3 and FIG. 4(*a*), each actuator includes a bracket 44 having a jaw 46 and a channel 47. The configuration of the bracket allows the jaw to be inserted through the actuator slot such that the channel can be slid into engaging contact with one end of the actuator slot and, once the channel has received the end, the bracket is pivoted about the channel and end such that a downward facing shoulder 49 of the jaw abuts against the work piece 37 and laterally secures bracket 44 within actuator slot 42, as shown in FIG. 4(*a*).

In the illustrated embodiment, tool base 32 is supported by a plurality of legs 51 which provide ready access to the underside of the tool base thus facilitating installation and removal of the bend actuators. The legs are secured to the tool base by suitable means including, but not limited to, threaded fasteners. One will appreciated that other suitable means may be used to support tool base 32. For example, a workbench or other surface may be provided with an opening having a peripheral shoulder dimensioned to removably receive and support the tool base. Such an opening would allow an operator to remove one tool base from the workbench and replace it with another tool base as so desired. Alternatively, a mounting bracket or other means may be used to releasably or permanently mount the tool base directly to a wall, shelving or other structure.

With continued reference to FIG. 4(*a*), a portion of bracket 44 extends above tool base 32 such that the top surfaces of the bracket provide support points 53 upon which work piece 37 can be positioned, thereby forming a work plane coincident with the bottom surface of the work piece. One or more rests 54 may also be provided to abut against the underside of work piece 37 thereby vertically supporting the work piece with respect to the tool base. Such rests are particularly useful for supporting portions of the work piece which are not directly between two fold lines and are thus unsupported by actuators. One or more locators 56 may also be provided to laterally position the work piece on tool base 32, and more particularly, on support points 53. The tool base may be populated with locaters 56 about outline 39 such that the locaters will substantially abut against the peripheral side edges of the work piece, thereby laterally positioning the work piece.

An advantage of the modular design of bending tool system 30 is that the actuators, legs, rests, locators and other additional components may be readily removed from tool base 32 thereby allowing the tool base to be stored flat. One will appreciate that the legs, rests locators and other additional components may be configured to fold down against and/or into the tool base thereby also allowing the system to be stored flat. Also, the modular design allows for multiple tool bases, each configured for a particular work piece, may be easily stored when not in use. Furthermore, the modular design allows reductions in tool component inventory. It is only necessary to stock a sufficient number of actuators and components that is necessary to populate the one, two, three or however many tool bases will be used simultaneously. For example, if an assembly facility has the capability to assembly dozens of different 3D structure designs but only intends to assembly three or four 3D structure designs simultaneously or contemporaneously, the facility need only stock a sufficient number of actuators and additional components to populate three or four tool bases at a time, instead of having enough components to populate all of the tool bases.

One will appreciate that any particular design of a work piece will have one or more predefined fold lines, a definite folding sequence, or at least a preferred folding sequence, and a unique silhouette. For example, work piece 37 illustrated in FIG. 7(*a*) has five fold lines 35.1, 35.2, 35.3, 35.4, 35.5. In one embodiment, a fold sequence includes simultaneous folding along fold lines 35.1 and 35.2 (FIG. 7(*b*)), then along fold line 35.3 (FIG. 7(*c*)), fold line 35.4 (FIG. 7(*d*)), and finally along fold line 35.5 (FIG. 7(*e*)) thereby forming the final 3D structure. One will appreciate that folding along fold lines 35.1 and 35.2 may be sequential instead of simultaneous. For example, folding may occur along fold line 35.1 followed by folding along fold line 35.2, or vice versa.

One will also appreciate that the above-described folding sequences allow for folding to occur about a component 57 that has already been mounted on work piece 37. For example, component 57 may be a circuit board, cooling fan, or other desired component that is mounted to the work piece before the work piece has been positioned on the tool base. Alternatively, the component may be installed once the work piece is positioned on the tool base. As can be appreciated with reference to FIG. 7(*a*) through FIG. 7(*e*), such component installation and all folding operations may take place at the same workstation, namely, on tool base 32.

Engineers and designers may decide where to put one or more fold actuators 33 along each fold line and how to populated in the base plane with complementary rests 54 and locators 56. Also, the base plane may be provided with holes 58 to accommodate "swing outs" such as tabs 60. The holes provide clearance to allow the swing outs to swing through the tool base as the work piece is bent along the corresponding fold line, for example, hole 58 provides clearance for tab 60 to swing out through tool base 32 as the work piece is bent along fold line 35.2, as indicated by arrow SO in FIG. 7(*c*).

The tool base may also be provided with suitable clamping means in order to secure the work piece with respect to tool base 32. In the illustrated embodiment, actuators 33 are provided with actuator clamping hooks 61 which extend through clamping apertures 63 and pivot to secure work piece 37 with respect to tool base 32. The clamping apertures may be provided adjacent the desired fold lines of the work piece in order to provide a fulcrum point about which the unsecured portion of the work piece may be bent.

One will appreciate that other suitable clamping means may be used instead of, or in addition to the clamping hooks. For example, vacuum clamps which act upon the undersurface of the work piece, hook clamps discrete from the actuators which similarly extend though corresponding clamping apertures positioned adjacent to or remote from the fold lines, and/or other suitable clamping means may be used to secure the work piece to the tool base.

In the illustrated embodiment, actuator 33 includes a two-stage driver 65 that controls movement of both the clamping hook 61 to secure a portion of the work piece to the tool base and a bending arm 67 to apply force against an unsecured portion 68 of the work piece to effect bending along the fold line. The two-stage configuration of the driver is advantageous in that it reduces part count of the actuator thereby simplifying the design and reducing the manufacturing cost thereof.

A first portion of the driver stroke actuates the clamping hook while the remainder of the driver stroke actuates the bending arm. One will appreciate that means other than a two-stage actuator may be utilized in accordance with the present invention. For example, a first dedicated actuator means may be provided for bending and a second dedicated actuator means may be provided for clamping, particularly when discrete clamping means are used in addition to or instead of the clamping hooks. One will also appreciate that, while the illustrated driver 65 includes a double-acting pneumatic cylinder 70, other suitable actuator means can be used including, but not limited to, single-acting pneumatic cylinders, single or double acting hydraulic cylinders, electric motors, linear actuators and other suitable means to effect movement of the clamping hook and/or the bending arm.

Figure 5A:
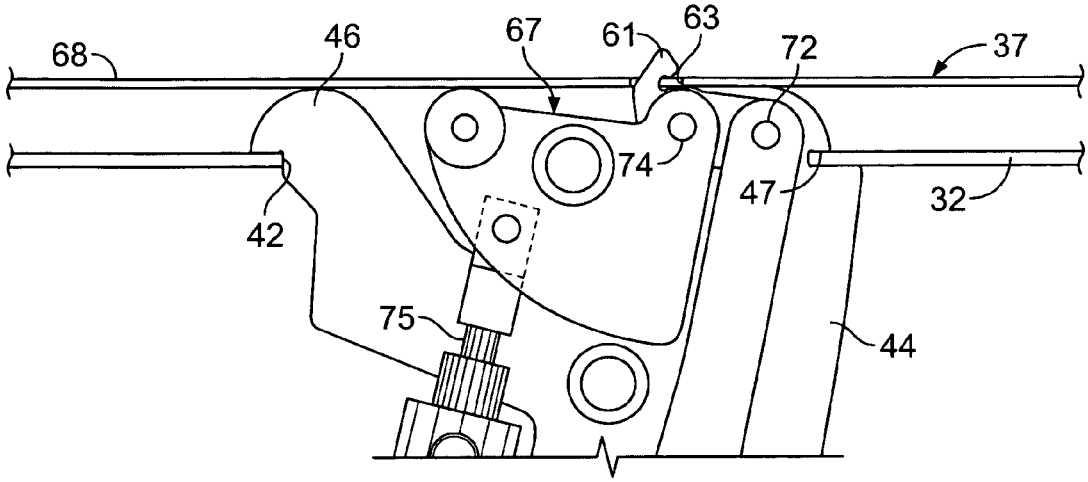
FIG. 5(*a*), 5(*b*) and 5(*c*) are a schematic, side elevational views of a work piece positioned on the modular actuator assembly of FIG. 2, said views illustrating the modular actuator in the initial position receiving the work piece, the clamp position securing the work piece to the work plane, and the bend position in which the tool system has folded the work piece along a fold line.
Figure 5B:
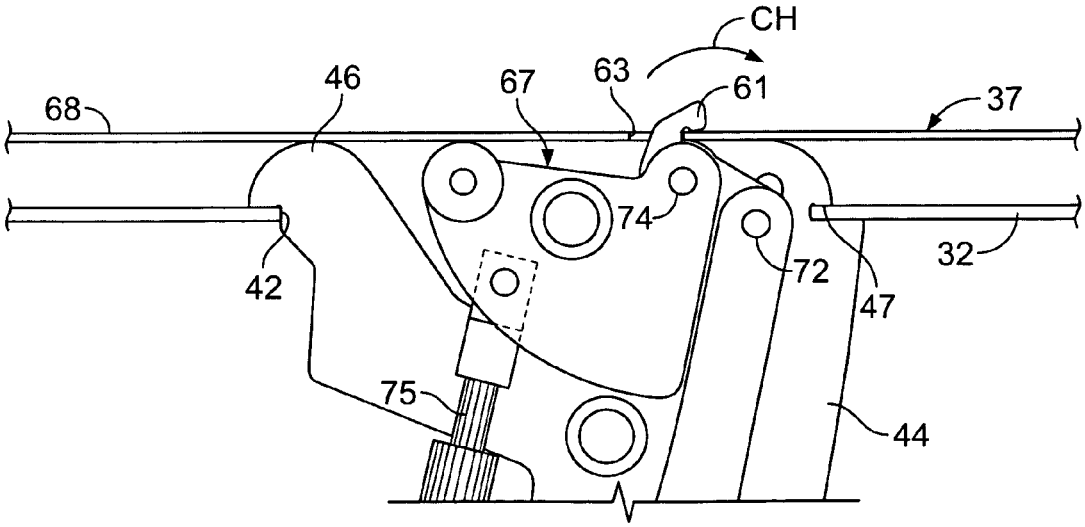
Figure 5C:
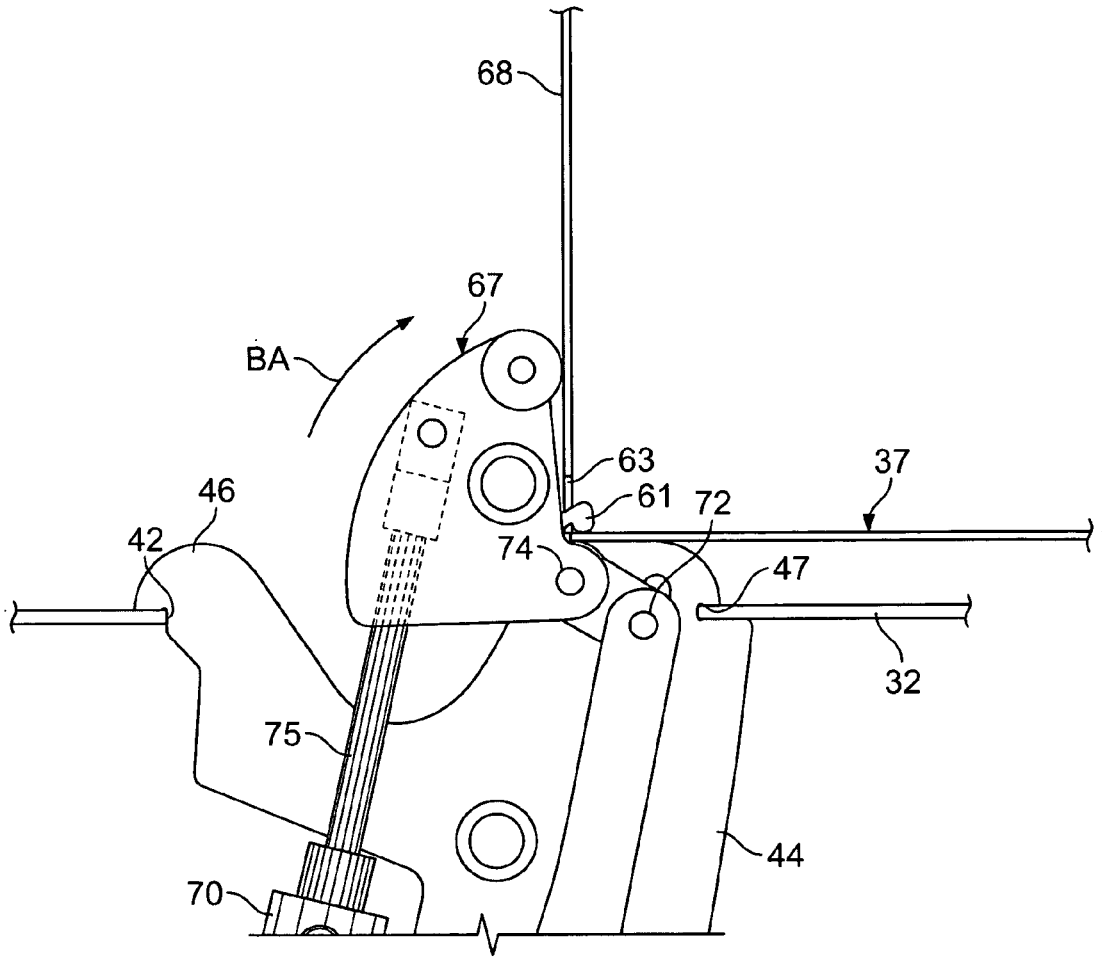

With reference to FIG. 4(*a*) and FIG. 5(*a*), the clamping hook is pivotally supported on bracket 44 by hook pivot 72, while the bending arm is pivotally supported on clamping hook by arm pivot 74. In an initial stage, clamping hook 61 is positioned off-center of hook pivot 72 (e.g., left of center), thus allowing placement of the work piece onto the tool base, as shown in FIG. 5(*a*). Turning to FIG. 5(*a*), clamping hook 61 extends through clamping aperture 63 in the initial stage and is thus ready to engage work piece 37. In the initial stage bending arm 67 is positioned in its initial retracted position in which the upper most portion of the bending arm is even with or slightly below support points 53.

As cylinder 70 is actuated, piston rod 75 extends upwardly and pushes bending arm 67 upward and causes the uppermost portion of the bending arm to contact work piece 37, in the event that it is not already contacting the work piece. Continued extension of the piston rod causes the bending arm, via arm pivot 74 to push against and effect pivotal motion of clamping hook 61 about hook pivot 72 in the direction of arrow CH, thereby causing the clamping hook to engage work piece 37, as shown in FIG. 5(*b*).

With clamping hook 61 engaging work piece 37, the clamping hook is limited from further motion, thus ending the clamping stage and beginning the bending stage. Continued extension of piston rod 75 causes bending arm 67 to pivot about the now-stationary arm pivot 74 in the direction of arrow BA until the unsecured portion 68 of the work piece 37 is bent to the desired angle, as shown in FIG. 5(*c*). The uppermost portion of bending arm 67 presses against the unsecured portion 68 of work piece 37 and effects bending about the fold line of work piece 37. The uppermost portion of the bending arm may be provided with a contact roller 77 which is free to roll along the undersurface of the work piece during bending. Such a contact roller prevents sliding contact of the bending arm along the work piece and thus minimizing scratching, wear or other damage to the work piece.

With reference to FIG. 5(*b*) and FIG. 5(*c*), clamping hooks 61 are designed to clamp work piece 37 down against the upper portion of brackets 44, the bending tool system leverages each bend on the actuator itself. Thus, minor torsion loads are conveyed back to the tool base thereby contributing for a light and relatively simple design of the tool base.

The dimensions and configuration of the bend actuator will dictate the particular angle bend imparted on the work piece. For example, in the illustrated embodiment, bend actuator 33 is configured to impart a 90° bend on work piece 37. One will appreciate, however, that the actuator may be adjustable such that the bend angle may be adjusted by adjusting the stroke of the driver, or by other suitable means. One will also appreciate that the pressure and dwell time of the actuators may also be adjusted to further control bending action.

One will also appreciate that the actuators may be dedicated to a particular type of fold (e.g., specific angle, etc.), a particular type of work piece (e.g., a work piece gauge, material type, etc.), or other parameters. For example, in one embodiment, the actuator is designed and configured to bend sheet metal having a thickness in the range of approximately 0.020" to 0.080". One will appreciate that additional larger actuators configured to bend thicker gauge sheet metal, for example, having a thickness in the range of approximately 0.050" to 0.110", or other greater thickness ranges, or additional smaller actuators configured to bend thinner gauge sheet metal, for example, having a thickness up to approximately 0.050" may be provided. Furthermore, in the event that different sized actuators are utilized, the actuator slits may be provided with a size and/or shape that is unique to each actuator size. Such a design will facilitate an assemblyperson in setting up the bending tool system as the assemblyperson need not refer to an assembly manual or other instructions and need only look at the size and/or shape of each actuator slot in a particular tool base and insert the appropriately sized actuator in each actuator slot.

One will also appreciate that the tool base may be similarly indexed to facilitate installation of the legs, rests, locators and other components. For example, the tool base may be provided with a first diameter bore 79 for the legs, a second diameter bore 81 for the rests, a third diameter bore 82 for the locators, and so on. Similarly, differently shaped holes or flanges may be provided which correspond to each component, for example, a square hole for the legs, a triangular hold for the rests, and so on. The sizes and/or shapes of the holes inform the assemblyperson what particular type component goes in each hole, thus obviating the need for referring to paperwork in setting up the bending tool system. The geometric code self-informs the assemblyperson which components, and quantity thereof, are necessary to set up the system.

The actuators may be controlled by suitable means to control the pressure and dwell time of each actuator, as well as the actuation sequence of the actuators. For example, a programmable logic controller 84 having a 16 channel valve assembly 86 is provided to control actuators 33 in any desired combination duration and/or sequence. The controller may be configured with a manual override 88 to activate any one or more actuators as desired, and/or a safety/off switch 89.

As noted above, identifying indicia may be burned into the tool base including an outline corresponding to the silhouette of the corresponding work piece. Similarly, the actuator order sequence, that is, the fold sequence may similarly be applied to the tool base. Such sequence indicia may be used to confirm that the bending sequence is in the correct order before the work piece is mounted on the bending tool system.

One will appreciate that the actual configuration of the controller may vary in accordance with the present invention. For example, the valve assembly may be configured to adjust the pressure applied to each actuator in order to adjust the amount of force each actuator applies to the work piece. Also, in the event that actuator means other than pneumatic cylinders are used, the controller may be configured to activate single or double acting hydraulic cylinders, electric motors or solenoids, and or other suitable actuator means.

Advantageously, the bending tool system of the present invention provides a simple and safe method of defining 3D objects from 2D sheet materials. The tool system may be used in the assembly environment instead of the fabrication environment as it obviates the use of press brakes, progressive dies and other heavy machinery. The bending tool system of the present invention may readily be located in an assembly line after or between various fabrication stations on which a profiling, punching, laser cutting or other operation takes place. Furthermore, the bending tool system may be located in an assembly line before or after various finishing stations.

Also, the bending tool system of the present invention allows 2D sheet material parts to be transported directly to the assembly space, and thus allows the product to be transported flat through as much of the manufacturing process as possible. Various methods can be utilized to feed the work piece to the tool base including, but not limited to, overhead vacuum delivery devices that can be used to place the work piece onto the tool base.

The bending tool system can be used in an environment having varying degrees of skilled labor. Operators need not be skilled in using press brakes, progressive dies and other machine tools. The bending tool system and method of the present invention promote safety as all moving parts are substantially confined below tool base 32 and the work piece 37.

One will also appreciate that the bending tool system of the present invention may also be used to assist in bending sheet materials. For example, assembly tabs may be used to interlock folded sections of the 2D sheet material once it has been into a 3D object, as is shown in FIGS. 28(*a*)-(*e*) of the '250 application. It would be difficult, if not impossible, to utilize known apparatuses to bend and assemble such "tabbed" 2D sheet materials as such assembly tabs need to be carefully aligned with corresponding slots during the assembly process. In contrast, the bending tool system of the present invention may be used to assist an operator by providing sufficient force to effect bending of the work piece in such a manner that the operator may simultaneously align the tabs 91 with their corresponding assembly slots 93 (see, e.g., FIG. 7(*e*)). Thus, the bending tool system may also be used to minimize the physical exertion required by the operator and thus avoid repetitive stress injuries such as carpal tunnel syndrome and other ailments.

Furthermore, the pneumatic cylinder, or other actuator means, may be adjusted such that the force applied to the work piece is sufficient to bend the work piece, but is insufficient to cause injury to the operator in the event that the operator inadvertently pinches a finger or limb. Similarly, the actuator means may be adjusted such that the tooling system uses forces that are sufficiently low such that there is no danger of damaging the components, such as the above-mentioned component 57.

It is also anticipated that the bending tool system of the present invention may be fully automated with increased folding speed. In the event that the process is fully automated, for example, with automated work piece delivery and transfer, an operator need not be present at the tool base. In such case, folding speed could be increased as such increase in speed would not increase the likelihood of injury to the operator because the operator need not be present. Thus, the bending tool system of the present invention may be used to increase throughput speed of the assembly process.

For convenience in explanation and accurate definition in the appended claims, the terms "up" or "upper", "down" or "lower", "inside" and "outside" are used to describe features of the present invention with reference to the positions of such features as displayed in the figures.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A bending tool system for forming a three-dimensional structure from a two-dimensional sheet material which includes a predetermined fold line and a clamping aperture adjacent said fold line and spaced from a peripheral edge of said sheet material, said system comprising:

a tool base for receiving and supporting said sheet material in a work plane, said tool base having an actuator slot;

a bend actuator extending through said actuator slot, said bend actuator including a mounting bracket, a clamp pivotally mounted to said bracket below said work plane, extending above said tool base, and movable between an open position and a secured position for securing a portion of the sheet material relative to said tool base, and a bending arm connected to said bracket below said work plane and movable between an initial position located below said work plane and an upper position in order to apply a force against an unsecured portion of sheet material to effect bending of said sheet material about the fold line; and a locator for positioning said sheet material relative to said work base such that said clamp extends through the clamping aperture of the sheet material.

2. A system according to claim 1, wherein said tool base is configured to be used with a particular sheet material design having a peripheral shape and predefined fold pattern, wherein said tool base further comprises an outline corresponding to the peripheral shape for identifying the particular sheet material design to be worked on said tool base.

3. A system according to claim 1, said system further comprising one or more legs removably attached to said tool base for supporting said tool base and providing access to said aperture slots from below said tool base.

4. A system according to claim 3, said system further comprising a rest removably attached to said tool base for supporting the sheet material above said tool base in the work plane.

5. A system according to claim 4, wherein said tool base has a first bore having a first size and shape complimentary to said locator, a second bore having a second size and shape complimentary to said legs, and a third bore having a third size and shape complementary to said rest, whereby the respective size and shape of said bores provide visual indication of the location of the locater, legs and rest.

6. A system according to claim 1, wherein said bracket further comprises having a channel and an opposing jaw with a downward-facing shoulder, wherein an upper portion of said bend actuator is inserted through said actuator slot from below said tool base, said channel is interlocked to one end of said actuator slot, and said bend actuator is dropped downward to abut said downward-facing shoulder against an opposite end of said actuator slot to secure said actuator to said tool base.

7. A system according to claim 1, said bend actuator further comprising a driver operably connected to said bending arm, wherein actuation of said driver moves said bending arm between said initial position and said upper position.

8. A system according to claim 7, wherein said driver is also operably connected to said clamp such that actuation of said driver also moves said clamp between said open position and said engaged position.

9. A system according to claim 8, wherein said driver is a pneumatic cylinder having a cylinder stroke, wherein a first portion of the cylinder stroke effects movement of said clamp and a second portion of said cylinder stroke effects movement of said bending arm.

10. A system according to claim 9, wherein said clamp is pivotally mounted on said bracket and said bending arm is pivotally mounted on said clamp.

11. A system according to claim 10, wherein one end of said pneumatic cylinder is operably connected to said bracket and an opposite end of said pneumatic cylinder is operably connected to said bending arm.

12. A system according to claim 1, wherein the sheet material has a predetermined pattern of fold lines and a clamping aperture adjacent each of said fold lines, said system comprising a plurality of bend actuators positioned to effect bending along a respective fold line, said tool base including a corresponding actuator slot for each said bend actuator.

13. A system according to claim 12, wherein each bend actuator includes a driver for moving each respective bending arm between said initial position and said upper position and for moving a respective clamp between said open position and said engaged position.

14. A system according to claim 13, wherein said system further comprises a programmable logic controller for controlling the actuation sequence of said drivers and the actuation force and dwell time of each said driver.

15. A system according to claim 14, wherein each said driver is a pneumatic cylinder having a cylinder stroke, wherein said controller provides two-stage actuation of each said driver wherein said driver controls a first portion of the cylinder stroke to effect movement of said clamp and a second portion of said cylinder stroke to effect movement of said bending arm.

16. A bending tool system for forming a three-dimensional structure from a two-dimensional sheet material which includes a predetermined fold line and a clamping aperture adjacent said fold line and spaced from a peripheral edge of said sheet material, said system comprising:

a tool base for receiving and supporting said sheet material in a work plane;

a clamp for laterally moving in the general direction of the work plane and engaging against said sheet material to secure a portion of said sheet material relative to said tool base;

a locator for laterally and longitudinally positioning said sheet material relative to said tool base such that said clamp extends through said clamping aperture; and a bending arm located adjacent said clamp, said bending arm movable from an initial position located below said work plane to an upper position in order to apply an upward force against an unsecured portion of said sheet metal to effect bending of said sheet material about said fold line.

17. A system according to claim 16, further comprising a bend actuator that includes said bending arm, wherein said tool base includes an actuator slot configured to removably receive a portion of said bend actuator inserted through said actuator slot.

18. A system according to claim 17, wherein said bend actuator further comprises a bracket having a channel and an opposing jaw with a downward-facing shoulder, wherein an upper portion of said bend actuator is inserted through said actuator slot from below, said channel is interlocked to one end of said actuator slot, and said bend actuator is dropped downward to abut said downward-facing shoulder against an opposite end of said actuator slot to secure said actuator to said tool base.

19. A system according to claim 18, said bend actuator further comprising a driver operably connected to said bending arm, wherein actuation of said driver moves said bending arm between an initial position located below said work plane and an upper position located above said work plane.

20. A system according to claim 19, said bend actuator further comprising said clamp, wherein said driver is also operably connected to said clamp such that actuation of said driver also moves said clamp between an open position free of said sheet material and an engaged position holding said sheet material down relative to said tool base.

21. A method of forming a three-dimensional structure from a two-dimensional sheet material which includes a predetermined fold line, said method comprising:

forming a clamping aperture in said sheet material adjacent said fold line and spaced from a peripheral edge of said sheet material;

laterally and longitudinally positioning said sheet material on a tool base such that said clamp extends through said clamping aperture, a lower surface of said sheet material defining a horizontal work plane above said tool base;

horizontally moving said clamp to laterally engage against said sheet material to secure a portion of said sheet material relative to said tool base; and moving a bending arm, located adjacent to said clamp, from an initial position below said work plane to an upper position thereby applying an upward force against an unsecured portion of said sheet metal to effect bending of said sheet material about said fold line.

22. A method according to claim 21, wherein a bend actuator includes said bending arm, and said tool base includes an actuator slot configured to removably receive said bend actuator, said method further comprising:

inserting a portion of said bend actuator through said actuator slot and securing said actuator to said work base.

23. A method according to claim 22, wherein said bend actuator includes a bracket having a channel and an opposing jaw with a downward-facing shoulder, said inserting and securing step comprises:

inserting an upper portion of said bend actuator through said actuator slot from below, interlocking said channel against one end of said actuator slot, and dropping said actuator downward such that said downward-facing shoulder abuts against an opposite end of said actuator slot thereby securing said actuator to said tool base.

24. A method according to claim 23, wherein said bend actuator includes a driver operably connected to said bending arm, wherein said moving step is accomplished by actuating said driver to move said bending arm from said initial position located below said work plane to said upper position located above said work plane.

25. A method according to claim 24, wherein said bend actuator includes said clamp and said driver is also operably connected to said bending arm, wherein said engaging step is accomplished by actuating said driver to move said clamp from an open position free of said sheet material to an engaged position holding said sheet material down relative to said tool base.

26. A tool system in combination with sheet material for forming a three-dimensional structure from a two-dimensional sheet material which is to be folded along a plurality of lines, the sheet material including an opening adjacent each of said lines to allow holding said sheet material, said combination comprising:

sheet material to be folded along a plurality of lines having an opening adjacent each of said lines;

support means for receiving and supporting the sheet material, said means having at least one slot formed therein adjacent each of said lines;

actuator means extending through said slot, said actuator means including a mounting means;

holding means connected to said mounting means, extending from said support means, and movable between one position and another position for securing a portion of the sheet material relative to said support means;

bending means connected to said mounting means and movable between an initial position and another position in order to apply a force against an unsecured portion of the sheet material to effect bending of the sheet material about said line; and means for positioning the sheet material relative to said support means such that said holding means extends through the opening of said sheet material.

* * * * *

UNITED STATES PATENT AND TRADEMARK OFFICE

CERTIFICATE OF CORRECTION

PATENT NO. : 7,296,455 B2
APPLICATION NO. : 10/938170
DATED : November 20, 2007
INVENTOR(S) : Max W. Durney It is certified that error appears in the above-identified patent and that said Letters Patent is hereby corrected as shown below:

In claim 16, col. 13, line 16, change “metal” to --material--;

In claim 21, col. 13, line 51, change “said” to --a--;

In claim 21, col. 13, line 61, change “metal” to --material--;

Signed and Sealed this

Eighth Day of December, 2009

David J. Kappos

David J. Kappos
*Director of the United States Patent and Trademark Office*